US009415896B2

(12) United States Patent
Ng

(10) Patent No.: US 9,415,896 B2
(45) Date of Patent: Aug. 16, 2016

(54) REINFORCED PALLET

(71) Applicant: DE FRAZER INTERNATIONAL SDN BHD, Kuala Lumpur (MY)

(72) Inventor: Siang Ling Ng, Kuala Lumpur (MY)

( * ) Notice: Subject to any disclaimer, the term of this patent is extended or adjusted under 35 U.S.C. 154(b) by 0 days.

(21) Appl. No.: 14/768,153

(22) PCT Filed: Dec. 16, 2013

(86) PCT No.: PCT/MY2013/000257
§ 371 (c)(1),
(2) Date: Aug. 14, 2015

(87) PCT Pub. No.: WO2014/129883
PCT Pub. Date: Aug. 28, 2014

(65) Prior Publication Data

US 2016/0001919 A1 Jan. 7, 2016

(30) Foreign Application Priority Data

Feb. 20, 2013 (MY) ..... 2013700278

(51) Int. Cl.
*B65D 19/38* (2006.01)
*B65D 19/00* (2006.01)

(52) U.S. Cl.
CPC ..... *B65D 19/0073* (2013.01); *B65D 19/0095* (2013.01); *B65D 2519/00019* (2013.01); *B65D 2519/00024* (2013.01); *B65D 2519/00029* (2013.01); *B65D 2519/00034* (2013.01);
(Continued)

(58) Field of Classification Search
CPC ..... B65D 19/0073; B65D 19/0095; B65D 19/0053; B65D 19/0067
USPC ..... 108/56.1, 51.3
See application file for complete search history.

(56) References Cited

U.S. PATENT DOCUMENTS 2,287,740 A * 6/1942 Klouman ..... F27D 3/12 108/54.1
3,131,656 A * 5/1964 Houle ..... B65D 19/0095 108/51.3

(Continued)

FOREIGN PATENT DOCUMENTS

WO 2009034495 3/2009

*Primary Examiner* — Daniel Rohrhoff
(74) *Attorney, Agent, or Firm* — Preston Smirman; Smirman IP Law, PLLC

(57) ABSTRACT

The present invention discloses a pallet comprising a plurality of elongate base members (102) being spaced apart from one another at its long edges with a plurality of block structures (108) arranged one by one within and along the long edges of each base member (102) that the base member (102) carries a plurality of paired slits (106) and each slit (106) cuts into every block structure (108) at a predetermined length; and a plurality elongate deck units (101) perpendicularly disposed on top of the base members that each deck unit is defined by a first construct (103), with an n-shaped cross-sectional profile, sandwiched in between a pair of second constructs (104), with an inverted L-shaped cross-sectional profile, and each deck unit (101) has a conjoined horizontal flat surface and a pair of downwardly extending portions (105) formed by the contiguous first (103) and second constructs (104); wherein the paired vertical extending portions (105) of each deck unit (101) are slotted into the aligned paired slits (106) of each block structure (108) to link all the base members (102) with the deck units (101) together while the horizontal flat surface serves as a work surface.

10 Claims, 4 Drawing Sheets

(52) U.S. Cl.
CPC ..... *B65D2519/00044* (2013.01); *B65D 2519/00054* (2013.01); *B65D 2519/00059* (2013.01); *B65D 2519/00064* (2013.01); *B65D 2519/00069* (2013.01); *B65D 2519/00079* (2013.01); *B65D 2519/00089* (2013.01); *B65D 2519/00094* (2013.01); *B65D 2519/00099* (2013.01); *B65D 2519/00104* (2013.01); *B65D 2519/00124* (2013.01); *B65D 2519/00129* (2013.01); *B65D 2519/00134* (2013.01); *B65D 2519/00139* (2013.01); *B65D 2519/00273* (2013.01); *B65D 2519/00293* (2013.01); *B65D 2519/00333* (2013.01); *B65D 2519/00378* (2013.01); *B65D 2519/00442* (2013.01); *B65D 2519/00567* (2013.01)

(56) References Cited

U.S. PATENT DOCUMENTS 3,696,988 A * 10/1972 Nederveld ..... B65D 19/20 108/51.3
3,861,326 A 1/1975 Brown
4,690,360 A 9/1987 Looker
5,339,746 A * 8/1994 Vannatta ..... B65D 19/0012 108/51.3
5,365,857 A * 11/1994 Kilpatrick ..... B65D 19/0012 108/51.3
5,423,270 A * 6/1995 Kilpatrick ..... B65D 19/0012 108/51.3
5,799,584 A * 9/1998 Campbell ..... B65D 19/0026 108/51.3
6,079,337 A * 6/2000 Huang ..... B65D 19/0012 108/51.3
2003/0189153 A1 10/2003 Nakabayashi
2005/0247240 A1 * 11/2005 Nelson ..... B65D 19/0012 108/51.3
2010/0175595 A1 * 7/2010 Grietens ..... B65D 19/0095 108/51.3
2010/0224103 A1 * 9/2010 Ho ..... B65D 19/0026 108/51.3
2012/0312200 A1 * 12/2012 Monteith ..... B65D 19/0026 108/51.3

* cited by examiner

REINFORCED PALLET

CROSS-REFERENCE TO RELATED APPLICATION

The instant application is a national phase of PCT International Patent Application Serial No. PCT/MY2013/000257, filed Dec. 16, 2013, and claims priority to Malaysian Patent Application Serial No. PI 2013700278, filed Feb. 20, 2013, pending, the entire specifications of both of which are expressly incorporated herein by reference.

FIELD OF INVENTION

The present invention relates to a pallet with enhanced structural integrity to support high unit loads disposed on its work surface.

BACKGROUND OF THE INVENTION

Pallet provides a structural foundation for unit loads to be handled and transported in the logistic supply chain. With lifting equipment such as forklifts, jack devices, front loader or conveyors, the pallet provides protection for the goods that are securely stacked on top of it to be kept in storage or carried in transportation.

Various pallets have been designed and introduced to the public. An example of a pallet with its features disclosed in the public domain is a lightweight corrugated pallet under the patent number of U.S. Pat. No. 3,861,326. The pallet comprises at least one corrugated upper deck member being filled by rigid plastic foam filler at the flutes of the top side corrugations to provide added strength and rigidity to the upper deck. The upper deck member is supported by multiple spaced rigid plastic support members that are adhesively fastened to the underside corrugations of the upper deck. The spacing of the plastic support members allows entry of prongs of a forklift truck. The downside of this pallet is that the corrugated feature does not provide a flat working surface for the pallet and hence affects the stability of loads placed on top of the pallet.

Another prior art, U.S. Pat. No. 4,690,360 describes a cargo pallet having a rectangular shaped core that comprises a grid of a plurality of stringers and struts that forms a cross-hatch assembly with the stringers extending from one edge of the core to the other edge of the core and the struts being cross members between the stringers. The stringers and the struts have at least one cross-sectional portion substantially in a C-shape for a flat surface to be presented on either side of the cross-sectional portion. Two aluminium sheets are attached by rivets to the flat surfaces to cover the core. This pallet, however, lacks rigidity as the cross-hatch assembly with aluminium sheets attached on its surface does not provide sufficient strength to support large load and would fail easily. The lack of base members to support the base of the pallet also attributes to the weak structural integrity of the pallet.

From the abovementioned examples of pallets, it could be concluded that the rigidity and stability of a pallet are crucial to support heavy loads. It is therefore important to introduce a reinforced pallet with enhanced structural integrity to address the drawbacks of existing pallets.

SUMMARY OF INVENTION

The main aspect of the present invention is to provide a pallet for handling or storing goods.

Another aspect of the present invention is to provide a pallet with enhanced structural integrity such that it is capable of remaining stable under a heavy load.

Still another aspect of the present invention is to provide a two-way or a four-way pallet.

Yet another aspect of the present invention is to provide a pallet with reinforced base members to support the work surface and load.

Also another aspect of the present invention is to provide a pallet with a large work surface.

At least one of the preceding aspects is met, in whole or in part, by the present invention, in which the embodiment of the present invention describes a pallet comprising a plurality of elongate base members (102) being spaced apart from one another at its long edges with a plurality of block structures (108) arranged one by one within and along the long edges of each base member (102) that the base member (102) carries a plurality of paired slits (106) and each slit (106) cuts into every block structure (108) at a predetermined length; and a plurality elongate deck units (101) perpendicularly disposed on top of the base members that each deck unit is defined by a first construct (103), with an n-shaped cross-sectional profile, sandwiched in between a pair of second constructs (104), with an inverted L-shaped cross-sectional profile, and each deck unit (101) has a conjoined horizontal flat surface and a pair of downwardly extending portions (105) formed by the contiguous first (103) and second constructs (104); wherein the paired vertical extending portions (105) of each deck unit (101) are slotted into the aligned paired slits (106) of each block structure (108) to link all the base members (102) with the deck units (101) together while the horizontal flat surface serves as a work surface.

DETAILED DESCRIPTION OF THE INVENTION

Figure 1:
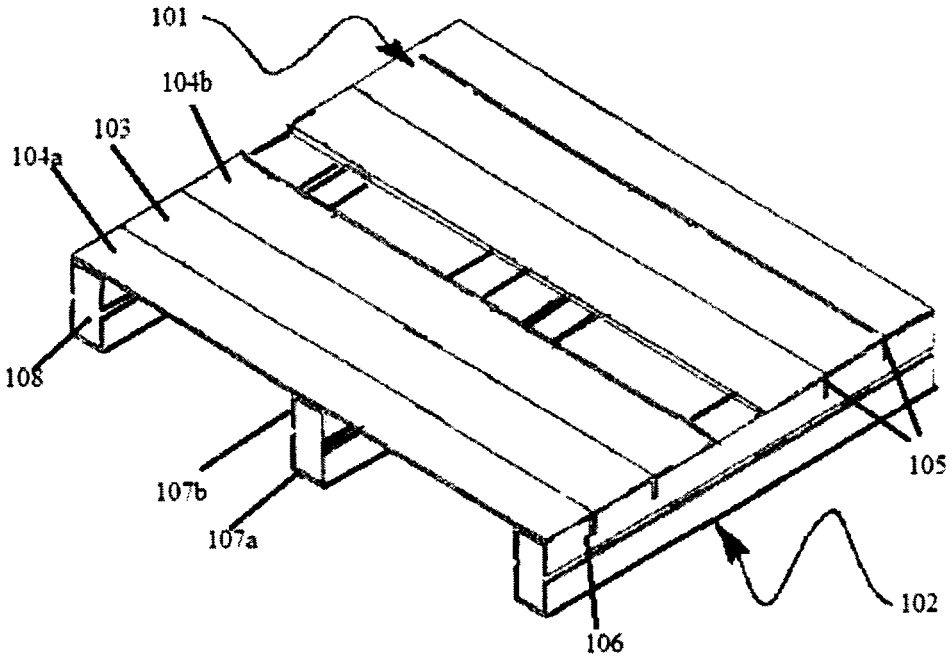
FIG. 1 is a diagram showing the perspective view of a two-way pallet with base members extending along the length of all deck units.

The present invention discloses a pallet comprising a plurality of elongate base members (102) being spaced apart from one another at its long edges with a plurality of block structures (108) arranged one by one within and along the long edges of each base member (102) that the base member (102) carries a plurality of paired slits (106) and each slit (106) cuts into every block structure (108) at a predetermined length; and a plurality elongate deck units (101) perpendicularly disposed on top of the base members that each deck unit is defined by a first construct (103), with an n-shaped cross-sectional profile, sandwiched in between a pair of second constructs (104), with an inverted L-shaped cross-sectional profile, and each deck unit (101) has a conjoined horizontal flat surface and a pair of downwardly extending portions (105) formed by the contiguous first (103) and second constructs (104); wherein the paired vertical extending portions (105) of each deck unit (101) are slotted into the aligned paired slits (106) of each block structure (108) to link all the base members (102) with the deck units (101) together while the horizontal flat surface serves as a work surface.

With reference to FIG. 1, the first construct (103) with the n-shaped cross-sectional profile has a horizontal flat surface and two downwardly extending protrusions whereas the second constructs (104*a*, 104*b*) with the L-shaped cross-sectional profiles each have a horizontal flat surface and a downwardly extending protrusion. By joining the three constructs (103, 104) together with the first construct (103) positioned in the middle of the second constructs (104*a*, 104*b*), the horizontal flat surfaces of the constructs (103, 104) are combined together to form a stable work surface with a large area for loads to sit on the work surface. Each of the downwardly extending protrusion of the first construct (103) is joined with the downwardly extending protrusions of the second constructs (104*a*, 104*b*) to form the pair of downwardly extending portions (105) for each deck unit (101).

Figure 2:
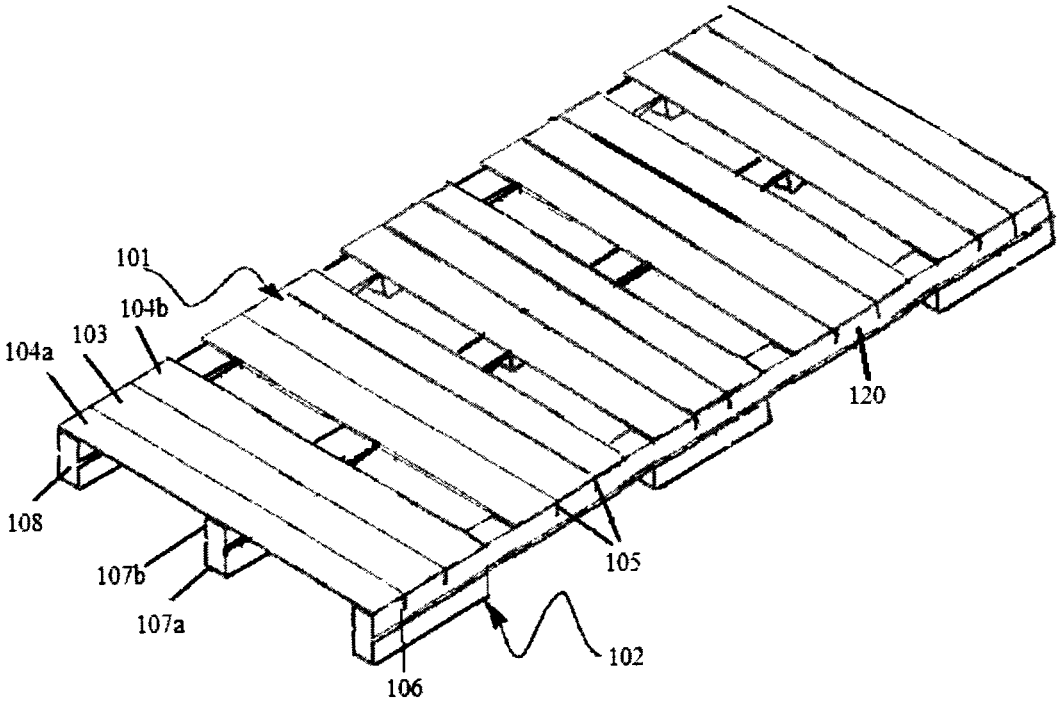
FIG. 2 is a diagram showing the perspective view of a four-way pallet with base members having deck units disposed on top of the top partial portions of the base members.

FIG. 1 shows a preferred embodiment of the pallet having base members (102) that extend along the length of all the deck units (101). The base member has a substantially uniform height. Such embodiment provides more stability to the base members (102) that are used to support the deck units (102). The embodiment shown in FIG. 1 is a two-way pallet that is designed to be entered and lifted by forklift from the front or rear of the pallet through the gaps between two individual base members (102). On the other hand, the embodiment depicted in FIG. 2 is a four-way pallet which allows forklift to enter from the front/rear as well as the sides of the pallet. The versatility of the present invention allows the production of two-way and four-way pallets. At least one bottom partial portion of each base member can be removed to form a gap for allowing forklift entry from the sides of the pallet. It is however preferred to have two bottom partial portions removed for each base member (102) as shown in FIG. 2 to form the four-way pallet. With the bottom partial portion being eliminated, the block structure (108) within the top partial portion (120) has a height smaller than the block structures (108) that are positioned inside the complete portions of the base members (102). Deck units (101) could be perpendicularly disposed on top of the top partial portion (120) of the base members for providing more work surface. The deck units (101) could have the same configuration as the two-way pallet shown in FIG. 1, whereby each deck unit is formed by a first construct (103) being sandwiched in between two second constructs (104). The top partial portions have slits (106) to receive the extending portions (105) of the constructs (103, 104).

Each base member (102) is formed by a plurality of block structures (108) that are housed within a casing. The block structures (108) are preferred to be in the shape of a cube or cuboid and are aligned one by one along the casing with or without being spaced apart from one another. The base member (102) carries a plurality of paired slits (106) and each slit (106) cuts into every block structure (108) at a predetermined length from the top surface of the base member (102) including the top surface of the casing. Hence, each block structure (108) has two slits (106) for receiving the two downwardly extending portions (105) of each deck unit (101). The position, alignment and shape of the slits (106) should correspond to the pair of downwardly extending portions of each deck unit (101) such that the portions (105) could be fitted snugly into the slits (106) to form effective joints between the deck units (101) and the base members (102). Also, it is required that the block structures (108) have a height which corresponds to the height of the base member (102) so that the downwardly extending portions (105) of the deck units (101) could reach the slits (106) on the base members (102).

Figure 3:
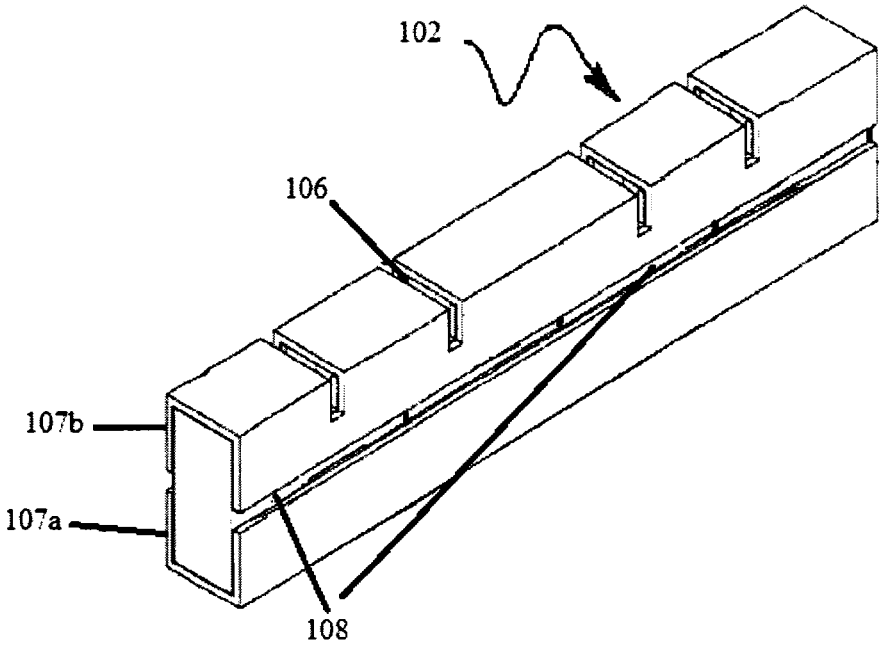
FIG. 3 is a diagram showing the perspective view of a base member with a casing formed by a pair of U-shaped channels.

Preferably, the casing which accommodates the block structures could be formed by one or a pair of U-shaped (107*a*, 107*b*) or C-shaped channels (107*c*, 107*d*). In the embodiment shown in FIG. 3, the casing that is formed by a pair of U-shaped channels (107*a*, 107*b*) comprise a bottom U-shaped channel (107*a*) and a top U-shaped channel (107*b*). The U-shaped channel (107*a*, 107*b*) has a horizontal part and two vertical parts extending towards the same direction at the sides of the horizontal part. The bottom U-shaped channel (107*a*) is disposed at the bottom of the base member (102) for the block structures (108) that are arranged one by one along the long edge of the U-shaped channels (107*a*, 10*b*) to sit on it. The block structures (108) fit snugly into the bottom U-shaped channel (107*a*), with the horizontal part and the two upwardly extending vertical parts extending upwards for embracing the bottom portion of the block structures (108). On the other hand, the top U-shaped channel (107*b*) is inversely positioned at the top of the base member (102), such that the vertical parts extend downwards. The top U-shaped channel (107*b*) sits on the block structures (108) and embraces the top portion of the block structures (108).

Figure 4:
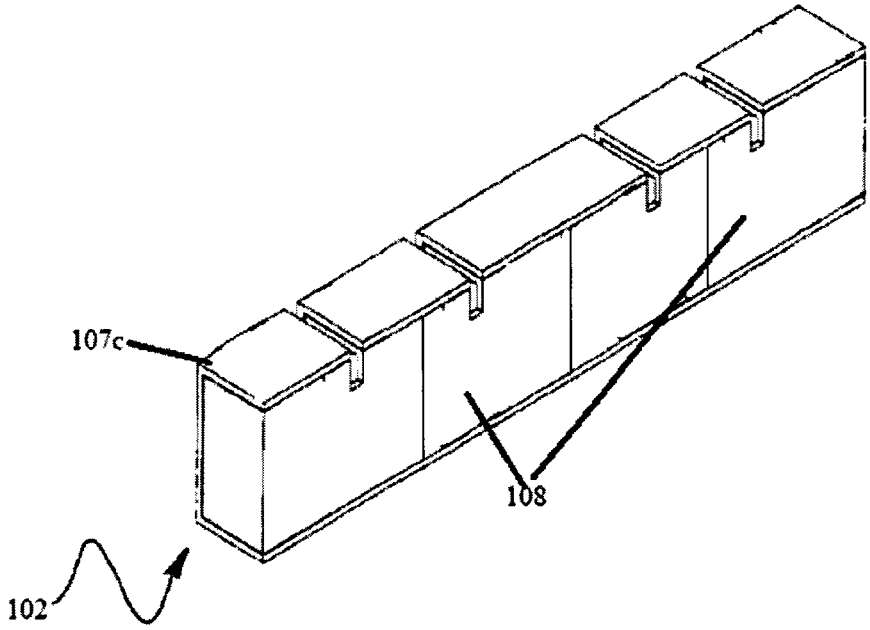
FIG. 4 is a diagram showing the perspective view of a base member with a casing formed by a C-shaped channel.

Another embodiment of the casing is illustrated in FIG. 4, in which the casing is formed by a single C-shaped channel (107*c*). The C-shaped channel (107*c*) has a vertical part with two horizontal parts extending from the top and bottom of the vertical part at the same direction embracing the top, bottom and one of the side surfaces of the block structures (108). The block structures (108) are fitted within the C-shaped channel (107*c*) one by one along the long edge of the C-shaped channel (107*c*).

Figure 5:
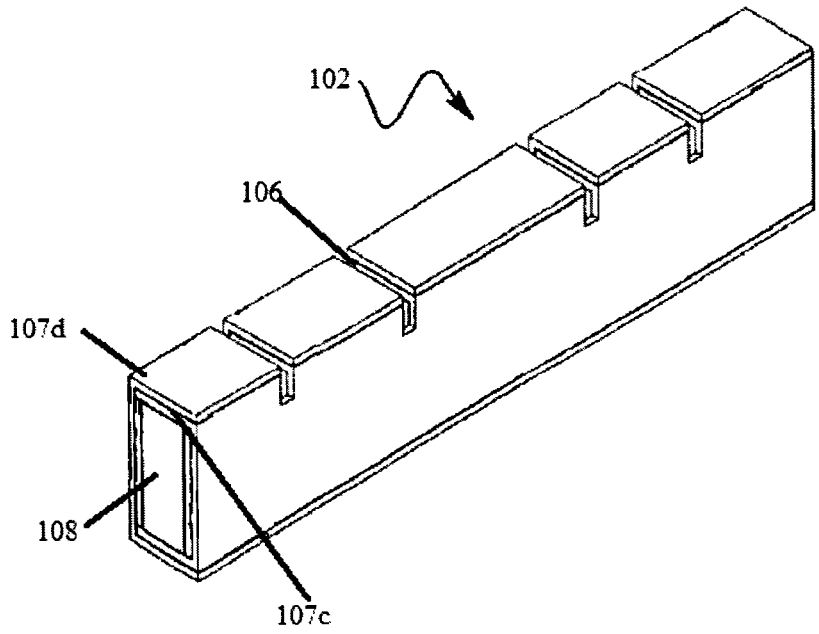
FIG. 5 is a diagram showing the perspective view of a base member with a casing formed by a pair of C-shaped channels.

A pair of C-shaped channels (107*c*, 107*d*) shown in FIG. 5 provide protection and enhance the rigidity of the base members (102) as compared to the embodiment of the pallet base member (102) in FIG. 4. The pair of C-shaped channels (107*c*, 107*d*) comprises a first C-shaped channel (107*c*) and a second C-shaped channel (107*d*). The first C-shaped channel (107*c*) has a smaller dimension than the second C-shaped channel (107*d*) and is disposed at one side of the base member (102) with the block structures (108) fitted within the C-shaped channels (107*c*, 107*d*) one by one along the long edges of the C-shaped channels (107*c*, 107*d*). The first C-shaped channel (107*c*) embraces the top, bottom and one side surfaces of the block structures (108) just like the embodiment in FIG. 4. On the other hand, the second C-shaped channel (107*d*) is inversely positioned to have its horizontal parts extending towards a direction opposite to the direction of the horizontal parts of the first C-shaped channel (107*c*). The second C-shaped channel (107*d*) embraces the block structures (108) and the first C-shaped channel (107*d*) from another side surface of the block structures (108), enclosing the top and the bottom surfaces of the first C-shaped channel (107*c*) at the same time. The first C-shaped channel (107*c*) and the block structures (108) have dimensions that enable them to be fit snugly within the second C-shaped member (107*d*).

Figure 6:
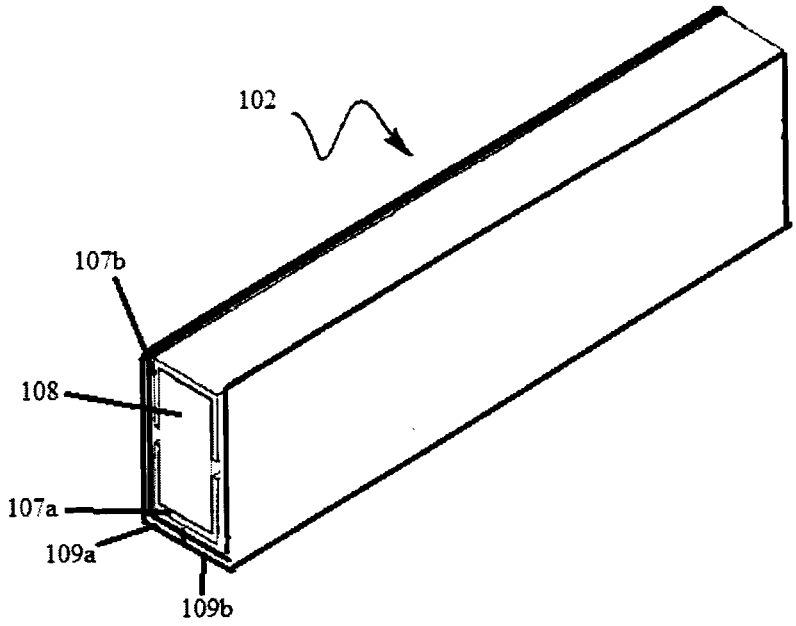
FIG. 6 is a diagram showing the perspective view of a base member with its casing being reinforced by a pair of L-shaped columns that are not overlapped at the bottom of the base member.
Figure 7:
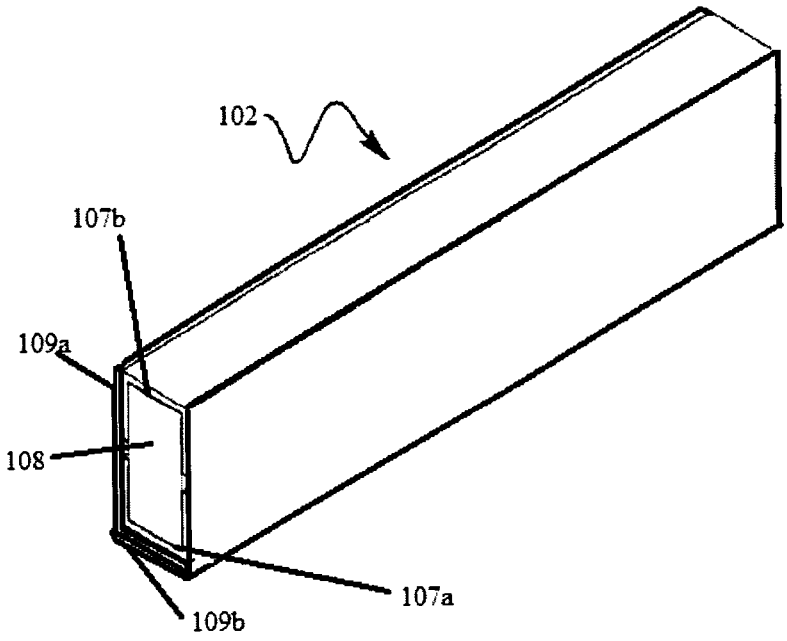
FIG. 7 is a diagram showing the perspective view of a base member with its casing being reinforced by a pair of L-shaped columns with one of the columns overlapping the other.

To enhance the structural integrity of the base members (102) such that the pallet could sustain high load, a pair of L-shaped columns (109*a*, 109*b*) are utilized to surround each long edge of the casing of each base member (102). The L-shaped column (109) has a vertical part and a horizontal part that are joined perpendicularly to each other. One of the L-shaped columns (109*a*) surrounds one side surface and the bottom surface of the base member (102) fully or partially whereas the other L-shaped column (109*b*) surrounds the opposite side surface and the bottom surface of the base member (102) fully or partially. If the L-shaped columns (109) cover the bottom surface of the base member (102) partially as depicted in FIG. 6, there is no overlapping of the horizontal parts to prevent the bottom surface for the base member (102) that is reinforced by the L-shaped columns (109) to be uneven. Conversely, if the L-shaped columns (109) cover the bottom surface fully as shown in FIG. 7, there is overlapping of the horizontal parts in a condition that each horizontal part has a surface area that is substantially similar to the bottom surface of the base member (102). One of the L-shaped columns (109*b*) should have larger dimensions in its height for its vertical surface and width for its horizontal surface as compared to the other L-shaped column (109*a*), such that the L-shaped column (109*a*) with smaller dimensions embraces one of the side surfaces and the bottom surface of the block structure (102) fully and the L-shaped column (109*b*) with larger dimensions embraces the smaller L-shaped column (109*a*) and the block structures (108) for forming an even bottom surface for the base member (102).

Figure 8:
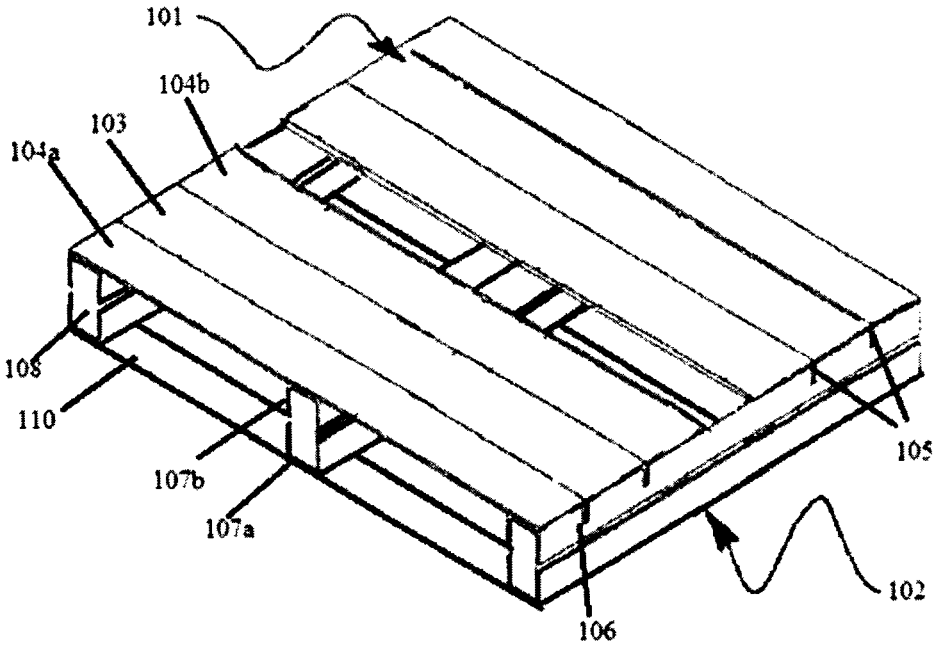
FIG. 8 is a diagram showing the perspective view of a pallet having a plurality of reinforcing pieces attached perpendicularly to the bottom of the base members.

Referring to FIG. 8, a plurality of elongate reinforcing pieces (110) could be added to the pallet to provide additional stability and protection to the base members (102). The pieces (110) are being spaced apart and attached perpendicularly along the bottom of the base members (102), spanning from the first base member (102) at one edge of the pallet to the last base member (102) at the opposite edge of the pallet.

As the material used to produce the pallet also plays an important role in determining the structural integrity of the pallet, a material with high strength and load resistance are suitable to be applied. Examples of the preferred materials are the high density fiberboard and medium density fiberboard. Other types of fiberboard or materials such as plywood, plastic, metal, laminated sheet papers, coreboard and paperboard including kraftliner or testliner could also be employed to produce the pallet.

Although the description above contains many specifications, it is understood that the embodiments of the preferred form are not to be regarded as a departure from the invention and it may be modified within the scope of the appended claims.

The invention claimed is:

1. A pallet, comprising:

a plurality of elongate base members being spaced apart from one another at its long edges with a plurality of block structures arranged one by one within, and along, the long edges of each base member such that each base member carries a plurality of paired slits and each slit cuts into every block structure at a predetermined length; and a plurality of elongate deck units perpendicularly disposed on top of the base members, wherein each deck unit is defined by a first construct, with an n-shaped cross-sectional profile, sandwiched in between a pair of second constructs, with an inverted L-shaped cross-sectional profile, and each deck unit has a conjoined flat surface and a pair of downwardly extending portions formed by contiguous first and second constructs;

wherein the extending portions of each deck unit are slotted into aligned paired slits of each block structure to link all the base members with the deck units together to form a work surface.

2. The pallet according to claim 1, wherein each base member has a substantially uniform height or has at least one bottom partial portion removed to form a gap in between two top partial portions of each base member.

3. A pallet according to claim 1, wherein each base member has a casing formed from one or a pair of U-shaped or C-shaped channels.

4. The pallet according to claim 3, wherein the casing formed by a pair of U-shaped channels comprises a bottom U-shaped channel and a top U-shaped channel, the bottom U-shaped channel being disposed at the bottom of each base member for the block structures that are arranged one by one along the long edges of the U-shaped channels to sit thereon, the top U-shaped channel being inversely positioned at the top of each base member to sit on the block structures.

5. The pallet according to claim 3, wherein the casing formed by the C-shaped channel is disposed at one side of each base member with the block structures fitted within the C-shaped channel one by one along the long edge of the C-shaped channel.

6. The pallet according to claim 3, wherein the casing formed by a pair of C-shaped channels comprises a first C-shaped channel and a second C-shaped channel, the first C-shaped channel having a smaller dimension than the second C-shaped channel and being disposed at one side of the base member with the block structures fitted within the first C-shaped channel one by one along the long edges of the C-shaped channels, the second C-shaped channel embracing the block structures and the first C-shaped channel from another side of each base member.

7. The pallet according to claim 1, further comprising a pair of L-shaped columns embracing every long edge of the casing of each base member.

8. The pallet according to claim 1, further comprising a plurality of elongate reinforcing pieces being spaced apart and attached perpendicularly along the bottom of the base members.

9. The pallet according to claim 1, wherein the block structures have a height that corresponds to the height of each base member.

10. The pallet according to claim 1, wherein the pallet is made of any one or combination of a high density fiberboard, medium density fiberboard, plywood, plastic, metal, laminated sheet papers, coreboard and paperboard.

* * * * *